United States Patent [19]

Takamatsu

[11] 4,035,876

[45] July 19, 1977

[54] DUAL FASTENER SLIDER

[75] Inventor: Ikuo Takamatsu, Uozu, Japan

[73] Assignee: Yoshida Kogyo Kabushiki Kaisha, Japan

[21] Appl. No.: 641,765

[22] Filed: Dec. 17, 1975

[30] Foreign Application Priority Data

Dec. 21, 1974 Japan ..... 49-155899

[51] Int. Cl.[2] ..... A44G 19/26; A44G 19/00

[52] U.S. Cl. ..... 24/205 R; 24/205.15 R; 24/205.11 R; 5/339

[58] Field of Search ..... 24/205.11 R, 205 R, 24/205.15 R; 5/339, 345

[56] References Cited

U.S. PATENT DOCUMENTS

| | | | |
|---|---|---|---|
| 2,331,048 | 10/1943 | Schaaff | 24/205 R |
| 2,351,803 | 6/1944 | Best | 24/205.15 R |
| 2,398,947 | 4/1946 | Marinsky | 24/205 R |
| 2,472,743 | 6/1949 | Carlile | 24/205.11 R |
| 2,905,230 | 9/1959 | Gabriel | 24/205 R |
| 3,019,456 | 2/1962 | Kamp | 5/355 |
| 3,138,842 | 6/1964 | Arthur | 24/205.11 L |
| 3,317,933 | 5/1967 | Meyer | 5/339 |
| 3,555,627 | 1/1971 | Howell | 24/205.11 R |
| 3,805,339 | 4/1974 | Howell | 24/205.11 R |
| 3,849,841 | 11/1974 | Borzner | 24/205.11 R |
| 3,903,571 | 9/1975 | Howell | 24/205.11 R |

FOREIGN PATENT DOCUMENTS

| | | | |
|---|---|---|---|
| 609,192 | 8/1926 | France | 24/205.11 R |
| 718,019 | 11/1954 | United Kingdom | 24/205.15 R |
| 894,401 | 4/1962 | United Kingdom | 24/205.11 L |

*Primary Examiner*—Bernard A. Gelak
*Attorney, Agent, or Firm*—Bucknam and Archer

[57] ABSTRACT

A slide fastener adapted for unopenably closing an opening in an upholstery covering of a seat. For semi-permanently locking a slider in a closed position on interlockable rows of fastener elements, a stop is fixedly mounted on the interlocked fastener elements in close contact with the rear end of the slider in the closed position. Typically, the stop is formed by a staple similar to the conventional bottom stop of a blind fastener.

2 Claims, 2 Drawing Figures

DUAL FASTENER SLIDER

BACKGROUND OF THE INVENTION

This invention relates to slide fasteners well adapted for unopenably closing openings in upholstery coverings of chairs, sofas and like articles, among other applications. More specifically, the invention is directed to improved means for semipermanently locking a slider in its closed position on interlocking rows of fastener elements or scoops to prevent any accidental or undesired opening of the fastener.

The slide fasteners heretofore employed for the application in question have usually been provided with sliders of the automatically locking or cam-locked type, such that the sliders, when moved to their closed position on the interlocking rows of fastener elements, are locked against movement in the fastener opening direction by the built-in lock mechanism. These sliders, however, have originally been developed for use on fasteners applied to plackets and other closure openings in garments, bags and the like. In the sliders of both known types, a locking pawl is provided which is actuated by the pull tab into and out of engagement with the fastener elements in the guide channel of the slider body.

The slide fasteners incorporating such locking sliders are therefore readily openable, after having been closed, by manipulating the pull tabs of the locked sliders in the usual manner. When such fasteners are applied to openings in upholstery coverings of chairs and the like, they may be opened, for example, by children out of curiosity. This is undesirable because then the rubber sponge or like filling material within the coverings can be easily taken out.

The use of the locking sliders is also objectionable from an economic point of view, since they are significantly more complex and therefore more expensive than the usual non-locking type. It is indeed unnecessary to use such expensive locking sliders because the fasteners applied to openings in upholstery coverings need almost never be opened when once closed.

SUMMARY OF THE INVENTION

It is an object of this invention to provide simplified, inexpensive means for locking a fastener slider in a closed position, practically against any possibility of accidental or undesired movement in the fastener opening direction, so that the noted deficiencies of the prior art are thoroughly overcome.

Briefly, the means herein comprehended comprises a stop fixedly mounted on interlocked rows of fastener elements so as to be in contact with the rear end of a slider in its closed position thereon. According to a preferred embodiment of this invention, the stop is formed by a staple similar to the bottom stop of a blind fastener which has been used conventionally to inseparably connect the fastener stringers at the bottom end of the rows of fastener elements.

The slider for use with the stop according to the invention can be of the usual non-locking type and need be equipped with no pull tab, so that the combined cost of the slider and stop is still significantly less than that of the conventional locking slider. Moreover, the slider can be locked in its closed position so positively that the fastener is not possibly openable by children, nor will it open accidentally as a result of crosswise pull exerted on the fastener stringers.

The above and other objects and advantages of the invention will become apparent in the course of the following description of a preferred embodiment illustrated in the accompanying drawings.

DESCRIPTION OF THE PREFERRED EMBODIMENT

Figure 1:
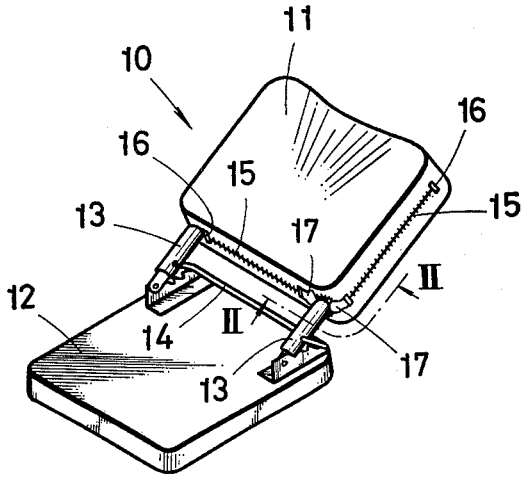
FIG. 1 is a perspective view illustrating one possible application of a slide fastener incorporating the means of this invention, the fastener being shown applied to openings in the covering of an upholstered back of a chair.

In the accompanying drawings the invention is shown adapted for semipermanently closing an opening in an upholstery covering of a chair. In FIG. 1, the numeral 10 generally designates the chair having an upholstered back 11 but no legs and intended to be squatted on, such chair being used on "tatami" or straw matting employed as a floor covering in Japanese homes. The upholstered back 11 of the chair 10 is pivotally coupled to a seat 12 via a pair of tubular posts 13, and the angle of the back relative to the seat is adjustable by a stay bar 14 pivoted to the posts.

A slide fastener including interlockable rows of fastener elements 15 is sewn or otherwise attached to the upholstery covering of the chair back 11 to close its opening extending over two adjacent sides of the back. The slide fastener extends past one of the posts 13 and has a pair of conventional end stops 16.

Figure 2:
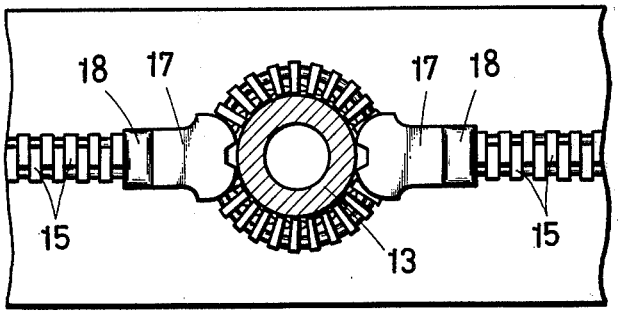
FIG. 2 is an enlarged fragmentary view taken along line II—II of FIG. 1, in which the fastener is shown substantially in a front view, and one of the posts of the chair shown in cross section.

As shown in FIG. 2, a pair of opposed sliders 17 of identical make are employed for closing the fastener in this particular adaptation of the invention, since the fastener extends past one of the posts 13 as aforesaid. The sliders 17 are shown in their fully closed positions on the rows of fastener elements 15, in which positions the sliders are in abutting contact with the post 13.

The sliders 17 need have no built-in lock mechanism, and pull tabs are also unnecessary because they are absolutely useless once the fastener is closed. A suitable tool can be employed for pulling the sliders to their illustrated closed positions along the rows of fastener elements 15.

For semipermanently locking the sliders 17 in their closed positions, a stop 18 is fixedly mounted on the interlocked rows of fastener elements 15 so as to be in close contact with the rear end of each slider. Each stop 18 can take the form of a staple similar to the conventional bottom stop of a blind fastener, that is, a strip of suitable material such as metal adapted to embrace the interlocked fastener elements. Such staples, however, should be sufficiently strong to positively lock the sliders in their closed positions in spite of the possible crosswise or transverse pull exerted on the fastener stringers to urge the sliders in the fastener opening direction.

While the present invention has been illustrated and described as embodied in a slide fastener closing an opening in an upholstery covering of a chair, it is not intended to be limited to this particular application nor to the exact constructional details shown. Numerous modifications or changes of the invention may be made by one skilled in the art without departing in any way from the scope of the following claims.

What is claimed is:

1. In a slide fastener arrangement on a covering having a peripheral opening through which a rod member extends the improvement comprising in combination: a pair of stringer tapes carrying along their confronting longitudinal edges rows of interlocking fastener elements, said longitudinal edges being spaced away from each other at a region of the stringer tapes to define intermediate the opposite ends of the stringer tapes said opening for the extension therethrough of the rod member, said rows of interlocking fastener elements being separated by said opening to provide a pair of separate paths therealong; a pair of independent sliders separate from each other and each being independently movable respectively along said paths and each slider having a front and rear end; and means for locking said sliders in respective opposite positions on the rows of fastener elements to close said opening except for a portion thereof between said sliders through which portion the rod member extends in contact with the sliders, said locking means including a pair of stop members fixedly mounted on the rows of fastener elements and positioned in close contact with the respective rear ends of the sliders to maintain the front ends of the sliders held against the opposite sides of the rod member.

2. The improvement according to claim 1 wherein said stop members are staples embracing the interlocked fastener elements.

* * * * *